US005857454A

United States Patent [19]

Shibaoka

[11] Patent Number: 5,857,454

[45] Date of Patent: Jan. 12, 1999

[54] WIRE SAW AND METHOD OF SLICING INGOT BY WIRE SAW

[75] Inventor: Shinji Shibaoka, Mitaka, Japan

[73] Assignee: Tokyo Seimitsu Co., Ltd., Tokyo, Japan

[21] Appl. No.: 675,894

[22] Filed: Jul. 5, 1996

[30] Foreign Application Priority Data

Jul. 7, 1995 [JP] Japan ..... 7-172319
Jul. 14, 1995 [JP] Japan ..... 7-178456

[51] Int. Cl.[6] ..... B24D 3/00

[52] U.S. Cl. ..... 125/16.02; 125/16.01; 125/35; 125/28

[58] Field of Search ..... 125/16.02, 16.01, 125/35, 28

[56] References Cited

U.S. PATENT DOCUMENTS 5,099,820 3/1992 Stricot ..... 125/16.01
5,201,305 4/1993 Takeuchi ..... 125/16.02
5,269,285 12/1993 Toyama et al. ..... 125/16.02
5,720,271 2/1998 Hauser ..... 125/28

FOREIGN PATENT DOCUMENTS 2752925 5/1979 Germany .

*Primary Examiner*—Robert A. Rose
*Assistant Examiner*—George Nguyen
*Attorney, Agent, or Firm*—Sixbey, Friedman, Leedom & Ferguson; David S. Safran

[57] ABSTRACT

An ingot mounting block consists of an attachment block, a horizontal rocking block and a vertical rocking block. The horizontal rocking block is provided in such a manner to rock horizontally with regard to the attachment block. The vertical rocking block is provided in such a manner to rock vertically with regard to the attachment block. A semiconductor ingot is positioned at the top of the vertical rocking block and is secured thereto. During an alignment of a crystal orientation, the horizontal rocking block and the vertical rocking block are previously inclined at a predetermined angle with regard to the attachment block, and then they are attached to a work feed table of a wire saw.

1 Claim, 14 Drawing Sheets

WIRE SAW AND METHOD OF SLICING INGOT BY WIRE SAW

BACKGROUND OF THE INVENTION

1. Field of the Invention

The present invention relates to a wire saw and a method of slicing an ingot by the wire saw, and more particularly to a wire saw and a method of slicing the ingot by the wire saw, for slicing the single crystal material such as silicon into a large number of wafers.

2. Description of the Related Art

When a wire saw slices an ingot such as silicon, the ingot needs to be inclined at a predetermined angle with regard to a wire row so that a sliced surface can be a predetermined crystal surface.

In the conventional wire saw, a tilting apparatus, which is integrated with a work feed table, aligns a crystal orientation for the ingot. The tilting apparatus supports the single crystal material so that the ingot can rock in vertical and horizontal directions with regard to the wire row. The user aligns the crystal orientation manually based on the previously-obtained data relating to the crystal orientation.

However, the tilting in the main body of the wire saw apparatus is restricted in space, so the operation is extremely difficult. Moreover, the operation requires much time, and the slicing cannot be performed efficiently.

Furthermore, if the ingot inclines vertically with regard to the wire row in order to be sliced, one end of the ingot is sliced first as shown in FIG. 14. So, there is a disadvantage in that the heat is concentrated at one side of grooved rollers which form the wire row; therefore, the slicing accuracy is lowered.

SUMMARY OF THE INVENTION

The present invention has been developed in view of the above-described circumstances, and has its object the provision of a wire saw and a method of slicing an ingot for slicing the ingot efficiently and accurately.

In order to achieve the above-mentioned object, in a wire saw, a running wire is wound around a plurality of grooved rollers to form a wire row, a single crystal material is attached to a work feed table via an ingot mounting block, the work feed table feeds toward the wire row so that the single crystal material is abutted against the wire row, and the single crystal material is sliced into a large number of wafers; and the wire saw is characterized in that the horizontal and vertical planes of the single crystal material are adjusted outside the wire saw, and then the single crystal material is attached to the work fed table so that the single crystal material is sliced.

Moreover, in order to achieve the above-mentioned object, in a wire saw, a running wire is wound around a plurality of grooved rollers to form a wire row, a single crystal material is attached to a work feed table via an ingot mounting block, the work feed table feeds toward the wire row so that the single crystal material is abutted against the wire row, and the single crystal material is sliced into a large number of thin-board shaped wafers; and the wire saw is characterized in that horizontal and vertical rocking mechanisms are provided in the ingot mounting block in order to incline the single crystal material to the wire row by a predetermined angle.

Furthermore, in order to achieve the above-mentioned object, a method of slicing a single crystal material into a large number of wafers by abutting them against the columnar single crystal material, which is fixed to a fixing part, against the running wire row; comprises the steps of rotating the single crystal material by a predetermined angle around its axis in its circumferential direction and in parallel to the wire row, rotating the single crystal material by a predetermined angle around an axis perpendicular to the axis of the single crystal material to find the crystal orientation of the single crystal material, and positioning and fixing the single crystal material, of which the crystal orientation is obtained, to the work feed table so that the single crystal material is sliced.

Furthermore, in order to achieve the above-mentioned object, a method of slicing a single crystal material into the large number of wafers by fixing the columnar single crystal material to the work feed table and abutting it against a running wire row; comprises the steps of rotating the single crystal material by a predetermined angle around its axis in its circumferential direction and fixing it to the work feed table in parallel to the wire row, and rotating the work feed table by a predetermined angle around an axis perpendicular to the axis of the single crystal material by a tilting mechanism provided in the work feed table so as to find the crystal orientation of the single crystal material so that the single crystal material is sliced.

According to the present invention, the horizontal and vertical planes of the single crystal material are adjusted previously at the outside of the wire saw. Then, the single crystal material is attached to the work fed table and is sliced.

According to claim 3 of the present invention, horizontal and vertical rocking mechanisms of the ingot mounting block, to which the single crystal material is attached, are inclined by a predetermined angle in horizontal and vertical directions, respectively, so that the crystal orientation of the single crystal material is aligned. As a result, the crystal orientation of the single crystal material can be aligned before the single crystal material is attached to the work feed table of the wire saw. Therefore, if the ingot mounting block is attached to the work feed table of the wire saw, the single crystal material can be replaced quickly. Moreover, the inclination operation can be performed at the outside of the wire saw, so the operation can be safer and easier than the conventional operation even at high altitude.

According to claim 8 of the present invention, the single crystal material is rotated by a predetermined angle around its axis in its circumferential direction in a state of being parallel to the wire row. The single crystal material is rotated by a predetermined angle around an axis perpendicular to the axis of the single crystal material, so that the crystal orientation of the single crystal material can be obtained. The single crystal material is sliced in a state of being parallel to the wire row. Therefore, the heat does not cluster on one side of grooved rollers which form the wire row. So, the slicing can be more accurate than the conventional method of inclining the single crystal material with regard to the wire row and slicing the single crystal material.

According to the present invention, the single crystal material is rotated by a predetermined angle around its axis in its circumferential direction, and is fixed to the work feed table in a state which is parallel to the wire row. The single crystal material is rotated by a predetermined angle around an axis perpendicular to the axis of the single crystal material by a tilting mechanism provided in the work feed table, so that the crystal orientation of the single crystal material is obtained. Then, the single crystal material is sliced by the wire row. As a result, the single crystal material is sliced in a state which is parallel to the wire row. Therefore, the heat is not concentrated on one side of grooved rollers which form the wire row. So, the slicing can be more accurate than the conventional method of inclining the single crystal material with regard to the wire row and slicing the single crystal material.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
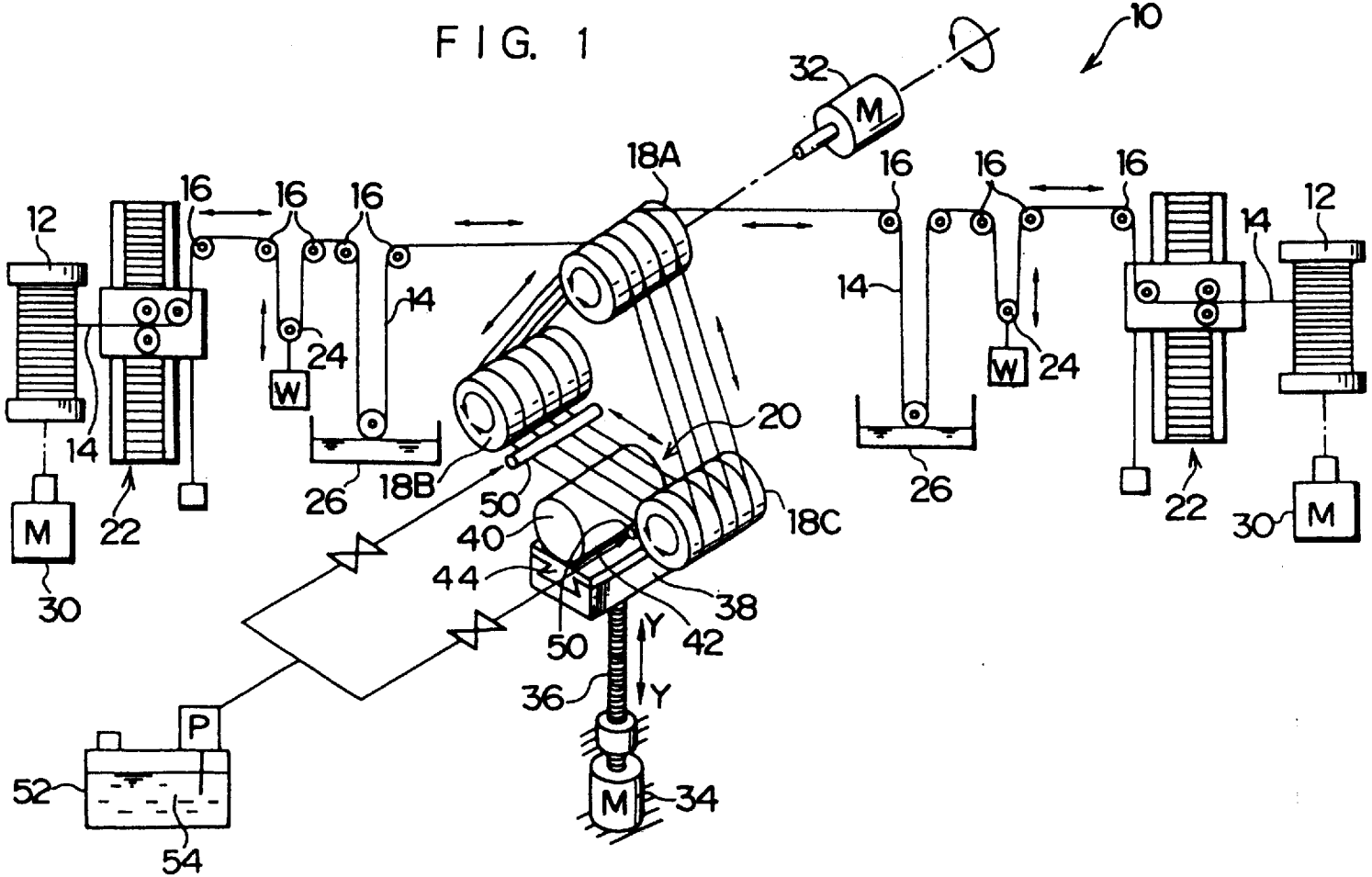
FIG. 1 is a view illustrating the whole structure of a wire saw.

FIG. 1 is a view illustrating the whole structure of a wire saw 10. As shown in the figure, a wire 14 is let out from one wire reel 12. Then, the wire 14 is wound around three grooved rollers 18A, 18B, and 18C via a wire running path, which is formed of guide rollers 16, 16 . . . Many grooves are formed at a constant pitch around the external circumference of the three grooved rollers 18A, 18B, and 18C. The wire 14 is wound around the grooved rollers 18A, 18B, and 18C sequentially, so as to form a horizontal wire row 20.

The wire 14, which forms the wire row 20, is wound up by another wire reel 12 via a wire running path, which is symmetric to the above-mentioned wire running path across the three grooved rollers 18A, 18B, and 18C.

Wire guiding apparatus 22, 22, dancer rollers 24 and 24, and wire cleansing aparatuses 26 and 26 are provided in each of the wire running paths, which are formed on both sides of the wire row 20. The wire guiding apparatus 22 and 22 guide the wire 14 from the wire reels 12 and 12 at a constant pitch. The dancer rollers 24 and 24 apply a constant tension to the running wire 14. The wire cleansing apparatus 26 and 26 eliminate the slurry stuck to the running wire 14.

Motors 30, 30 and 32, which can rotate in a forward direction, connect to a pair of the wire reels 12 and 12, and the grooved roller 18A. The wire 14 drives the motors 30, 30 and 32 synchronistically so as to run back and forth between the wire reels 12 and 12 at a high speed.

A work feed table 38 is arranged below the wire raw 20 by a screw mechanism 36 driven by the motor 34. The work feed table 38 moves forward and backward with regard to the wire row 20. A semiconductor ingot 40 is held on the top of the work feed table 38 by a slice base mounting beam 42 and an ingot mounting block 44.

A pair of slurry jetting nozzles 50 and 50 are arranged across the semiconductor ingot 40 above the wire row 20. The pair of slurry jetting nozzles 50 and 50 jet the slurry 54, which is stored in a slurry tank 52, toward the wire row 20.

In the wire saw 10, which is constructed in the above-mentioned manner, the work feed table 38 is lifted toward the wire row 20, and the semiconductor ingot 40 is abutted against the running wire row 20, so that the semiconductor ingot 40 is sliced. In this case, the slurry 54 is supplied to the wire row 20 via the slurry jetting nozzles 50 and 50. The semiconductor ingot 40 is sliced into wafers by a lapping operation of grinding abrasive included in the slurry.

Figure 2:
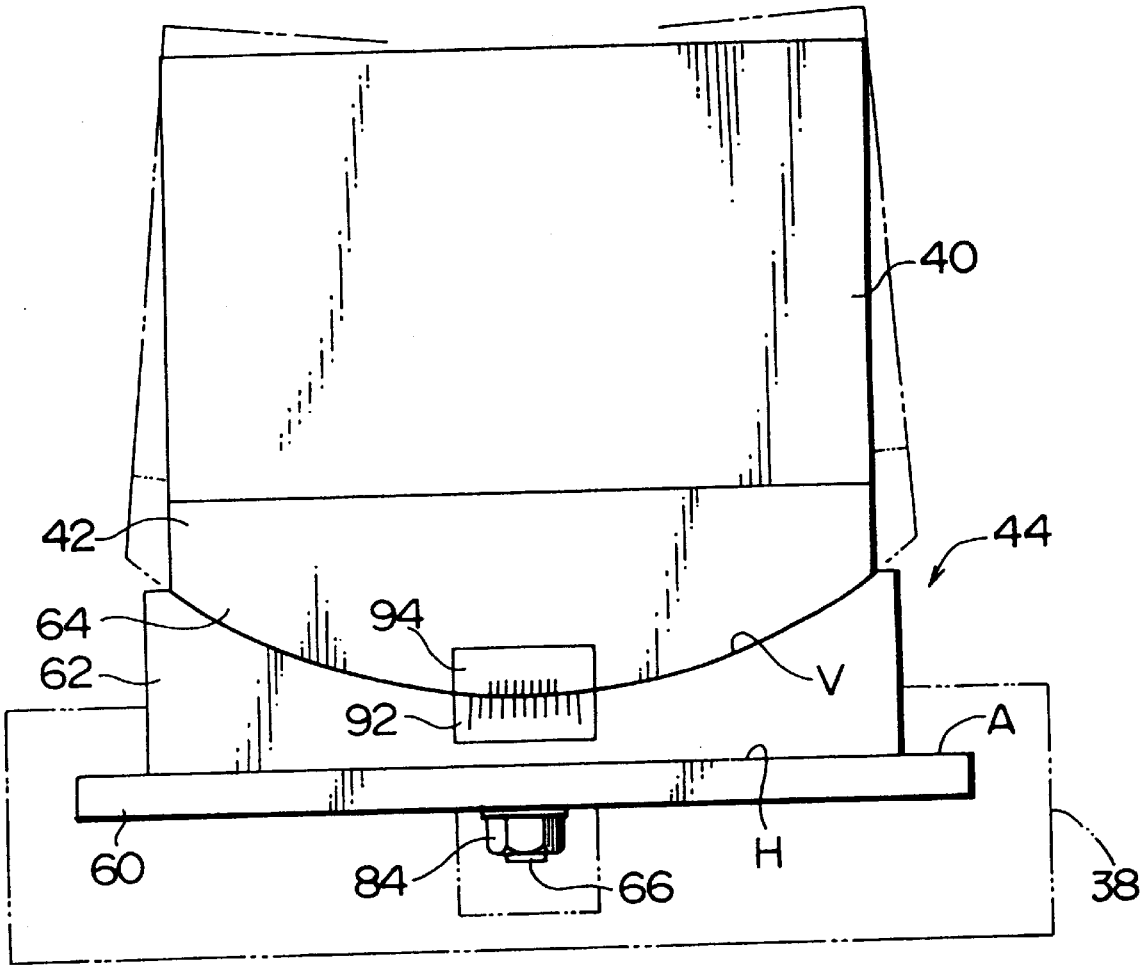
FIG. 2 is a side view illustrating an ingot mounting block in the first embodiment.
Figure 3:
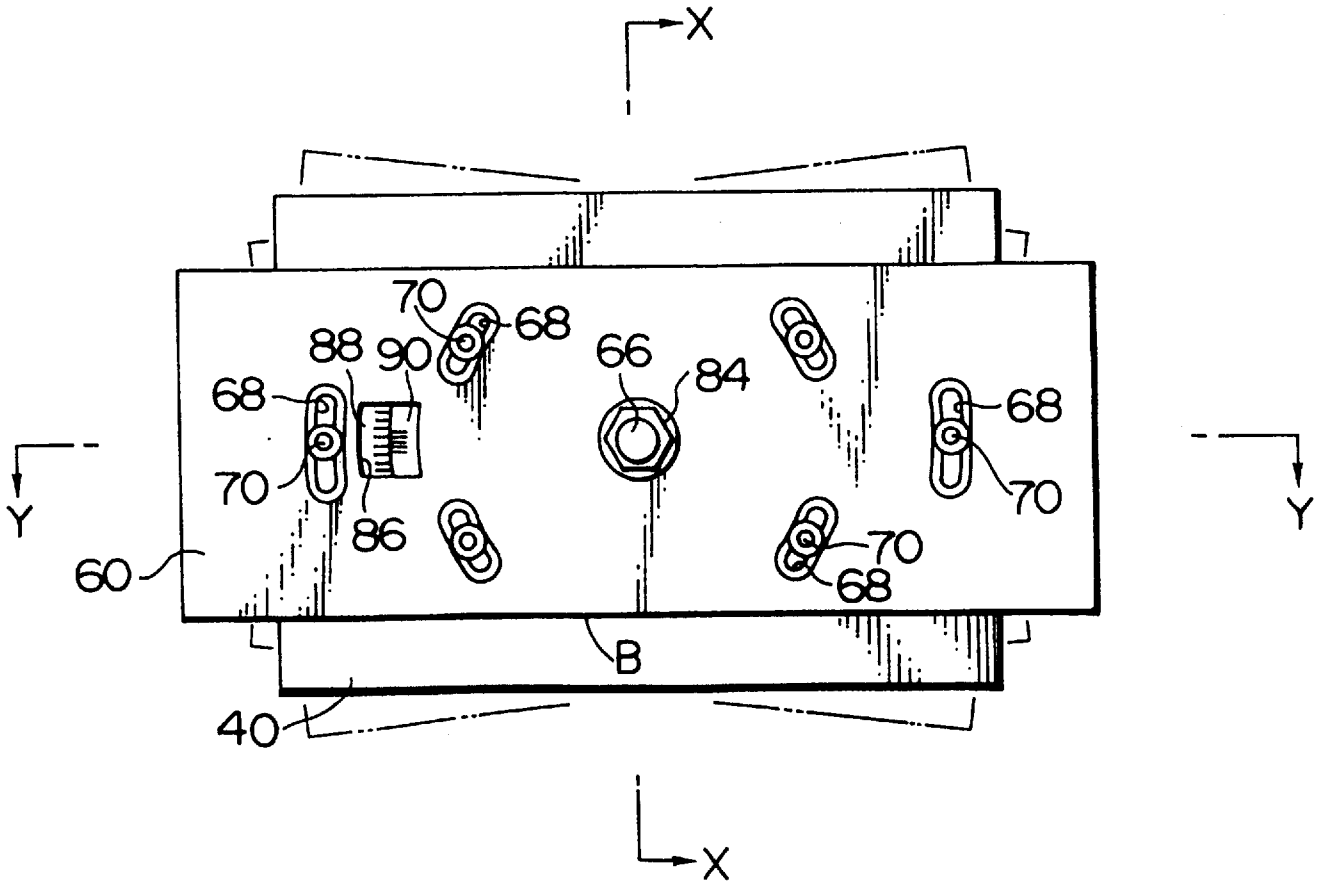
FIG. 3 is a plane view illustrating an ingot mounting block in the first embodiment.
Figure 4:
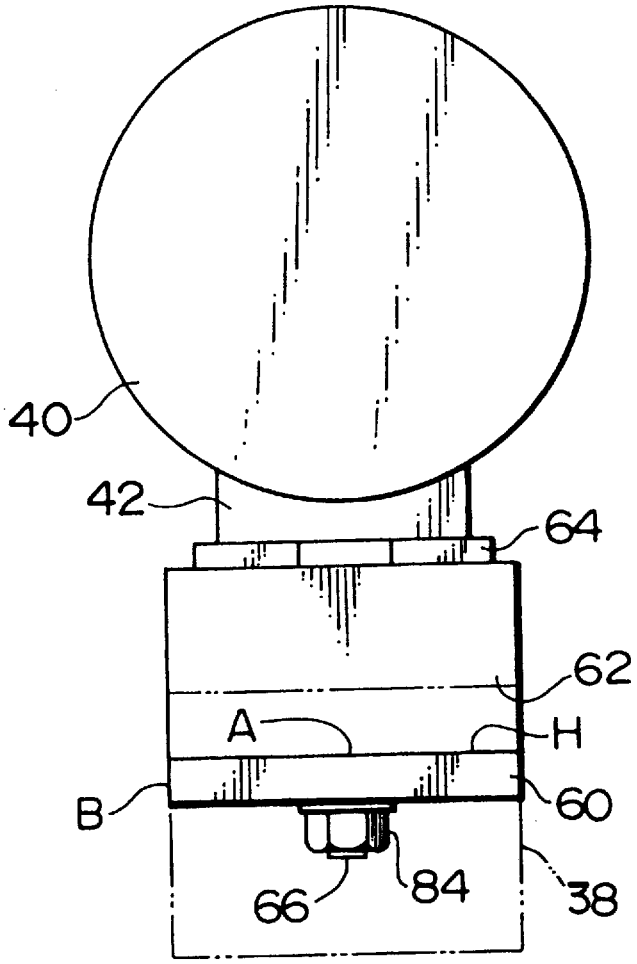
FIG. 4 is a front view illustrating an ingot mounting block in the first embodiment.
Figure 5:
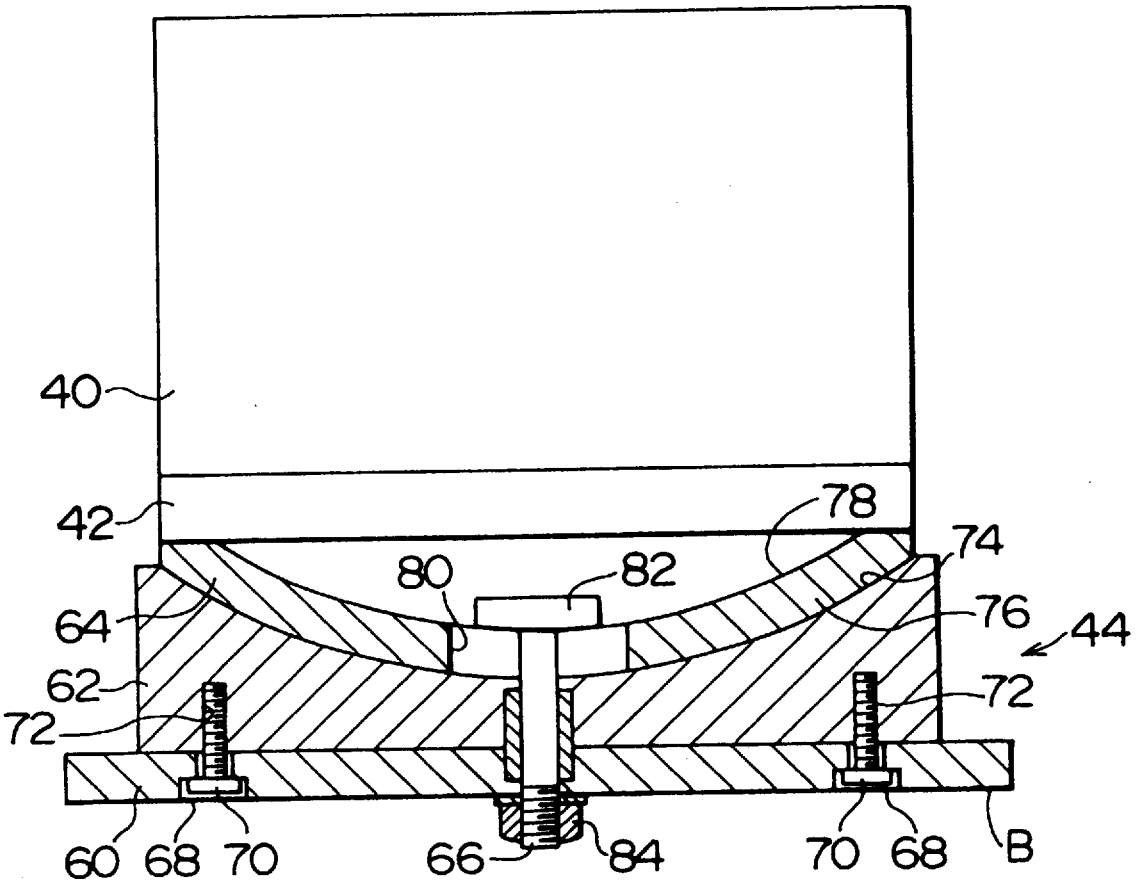
FIG. 5 is a section view taken along line X—X in FIG. 3.
Figure 6:
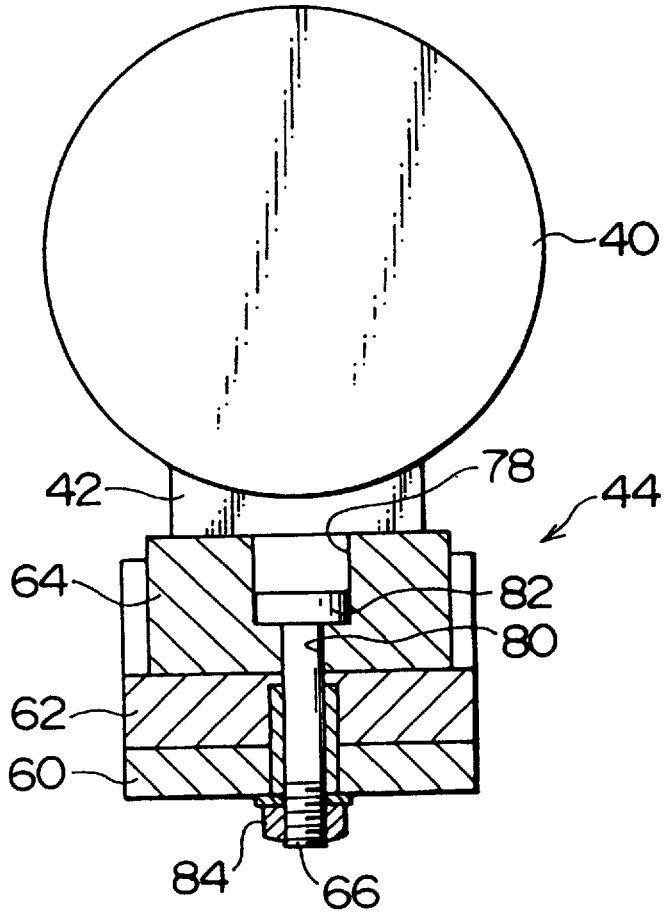
FIG. 6 is a section view taken along line Y—Y in FIG. 3.

FIGS. 2, 3, and 4 are a side view, a plane view, and a front view, respectively, of the ingot mounting block. FIGS., 5 and 6 are a section view taken along line X—X and a section view taken along line Y—Y, respectively, in FIG. 3.

As shown in FIGS. 2, 3, 4, 5, and 6, the main construction members in the ingot mounting block 44 are an attachment block 60, a horizontal rocking block 62, and a vertical rocking block 64. The members 60–64 are integrated with each other via a connection bolt 66.

The attachment block 60 is rectangular, and is attached to the work feed table 38, which has horizontal and vertical references with regard to the wire row 20. The attachment block 60 is attached and detached freely. An attachment reference plane A in the vertical direction is formed on the top of the attachment block 60, and an attachment reference plane B in the horizontal direction is formed at the side of the attachment block 60, when the attachment block 60 is attached to the work feed table 38.

As shown in FIG. 3, arc guide holes 68, 68, . . . are formed concentrically at the attachment block 60 around the connecting bolt 66. Guide bolts 70, 70, . . . are inserted into the guide holes 68, 68, . . . The inserted guide bolts 70, 70, . . . are engaged with bolts holes 72, 72, . . . on the bottom of the horizontal rocking block 62.

The horizontal rocking block 62, which is constructed in the above-mentioned manner, slides on a top surface of the attachment block 60. Then, the horizontal rocking block 62 tightens the guide bolts 70, 70, . . . so that the horizontal rocking block 62 can be fixed to the attachment block 60. When the guide bolts 70, 70, . . . are loosened, the horizontal rocking block 62 rocks in a horizontal direction around the connecting bolt 66.

A spherical concave surface 74 is formed on the top of the horizontal rocking block 62. On the other hand, a spherical convex surface 76, which corresponds to the shape of the spherical concave surface 74, is formed on the bottom of the vertical rocking block 64. An arc guide groove 78, which corresponds to the shape of the spherical convex surface 76, is formed at the bottom of the vertical rocking block 64. A hole 80 is formed at the center of the guide groove 78. The connecting bolt 66 is inserted into the hole 80. A piece 82 is secured to the top end of the connecting bolt 66, and the piece 82 is engaged with the guide groove 78.

The vertical rocking block 64, which is constructed in the above-mentioned manner, slides on a vertical reference plane V, which is formed on the spherical concave surface 74 of the horizontal rocking block 62. Then, the vertical rocking block 64 tightens a nut 84, which is engaged with the bottom end of the connection bolt 66, so that the vertical rocking block 64 is fixed to the attachment block 60. The vertical rocking block 64 loosens the nut 84 so as to rock vertically with regard to the attachment block 60.

The semiconductor ingot 40 adheres to the top of the vertical rocking block 64 via the slice base 42. In this case, the semiconductor ingot 40 adheres to the vertical rocking block 64, so that an end face of the semiconductor ingot 40 can be parallel to a vertical reference A of the attachment block 60, and that an axis of the semiconductor ingot 40 can be parallel to a horizontal reference B of the attachment block 60.

When the horizontal rocking block 62 rocks horizontally with regard to the attachment block 60, the adhered semiconductor ingot 40 inclines horizontally with regard to the attachment block 60. When the vertical rocking block 64 rocks vertically with regard to the attachment block 60, the semiconductor ingot 40 inclines vertically with regard to the attachment block 60.

Incidentally, if a horizontal angle graduation 88, which is formed on the bottom of the horizontal rocking block 62, is read by a horizontal rotation graduation 90 through a window formed on the top of the attachment block 60, an angle of inclination of the horizontal rocking block 62 is confirmed. If a vertical angle graduation 92, which is formed on the side of the horizontal rocking block 62, is read by a vertical rocking graduation 94 formed at the vertical rocking block 64, an angle of inclination of the vertical rocking block 64 is confirmed.

Next, an explanation will be given about an operation in the first embodiment of the wire saw's work bonding block according to the present invention, which is constructed in the above-described manner.

The crystal orientation of the semiconductor ingot 40 is previously confirmed by a X-ray irradiation apparatus. The ingot mounting block 44 determines an angle of inclination of the semiconductor ingot 40 with regard to the wire row 20 in horizontal and vertical directions, so that the semiconductor ingot 40 can be sliced in the crystal orientation.

First, the connecting bolt 66 and the nut 84 are loosened, so that the horizontal rocking block 62 and the vertical rocking block 64 can be rocked.

Next, the horizontal rocking block 62 is rocked, and the horizontal rotation graduation 90 is set to indicate a reference position (zero) of the horizontal angle graduation 88. The vertical rocking block 64 is rocked, and the vertical rotation graduation 94 is set to indicate a reference position (zero) of the vertical angle graduation 92. In this state, the connecting bolt 66 and the nut 84 are tightened again, so that the horizontal rocking block 62 and the vertical rocking block 64 can be fixed to the attachment block 60.

Then, the semiconductor ingot 40 is secured to the vertical rocking block 64 via the slice base mounting beam 42. As a result, a horizontal reference plane (orientation flat plane) and a vertical reference plane (end plane) are parallel to the horizontal reference plane A and the vertical reference plane B, respectively, of the attachment block 60.

Next, the connecting bolt 66 and the nut 84 are loosened again so that the horizontal rocking block 62 and the vertical rocking block 64 can be rocked with regard to the attachment block 60. Then, the horizontal rocking block 60 is rocked horizontally. When the crystal orientation of the semiconductor ingot 40 corresponds to the wire row 20, the guide bolts 70, 70, . . . are bolted, and the vertical rocking block 64 is fixed to the attachment block 60. In this case, the angle of inclination in the vertical direction is adjusted in view of the vertical angle graduation 92 and the vertical rotation graduation 94.

The above-mentioned sequential operation completes the positioning of the semiconductor ingot 40. In this state, the attachment block 60 is attached to the work feed table 38. Therefore, the semiconductor ingot 40 is set at the work feed table 38 so that the slicing surface is a predetermined crystal surface.

As has been described above, according to the ingot mounting block of the wire saw in the first embodiment, the crystal orientation of the ingot mounting block 44 is aligned before the semiconductor ingot 40 is set in the wire saw 10. As a result, the semiconductor ingot 40 can be replaced quickly.

Moreover, because the crystal orientation can be aligned outside the main body of the wire saw 10, the operation can be safer and easier than the conventional operation at a high place.

Furthermore, because it is not necessary to provide a tilting mechanism for inclining the semiconductor ingot 40 toward the main body of the wire saw 10, the structure of the wire saw 10 can be simplified.

Figure 7:
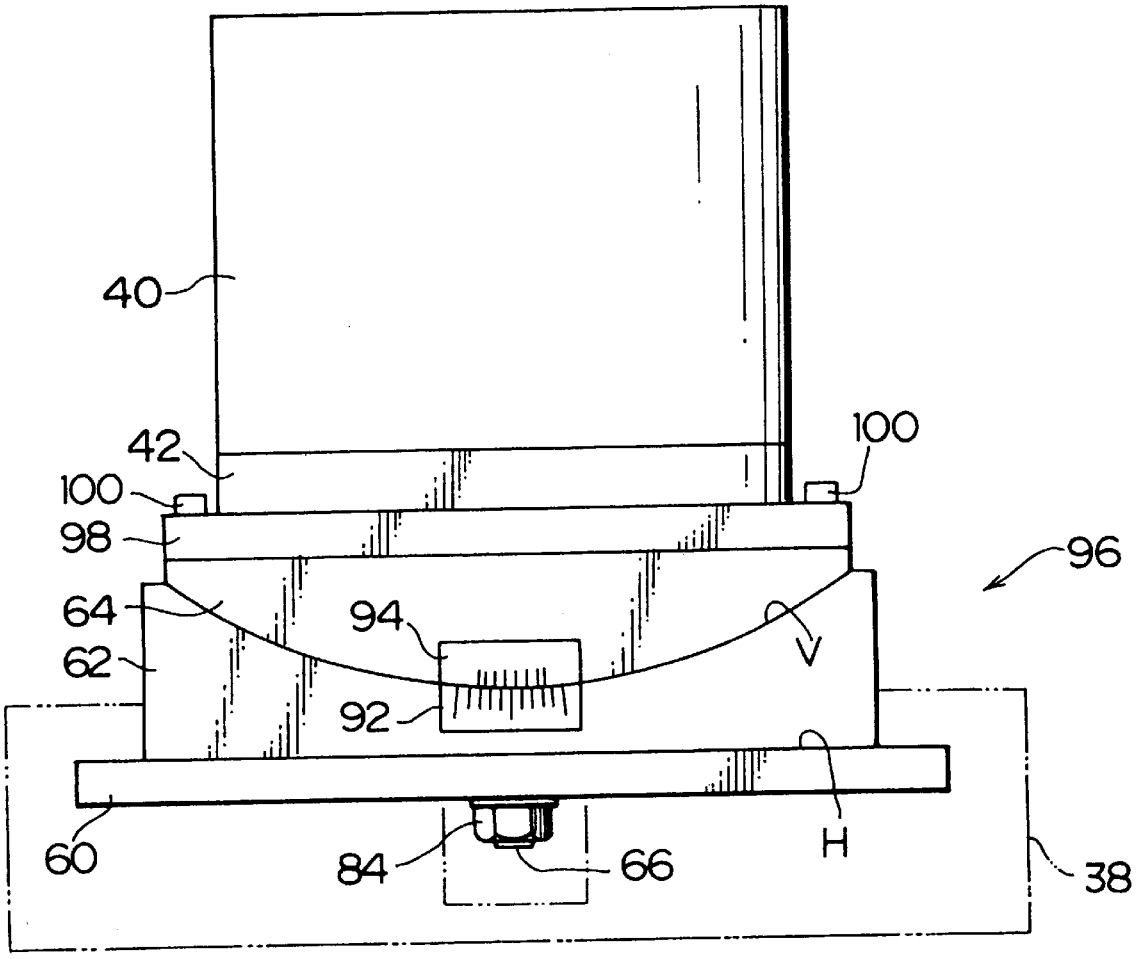
FIG. 7 is a side view illustrating an ingot mounting block in the second embodiment.
Figure 8:
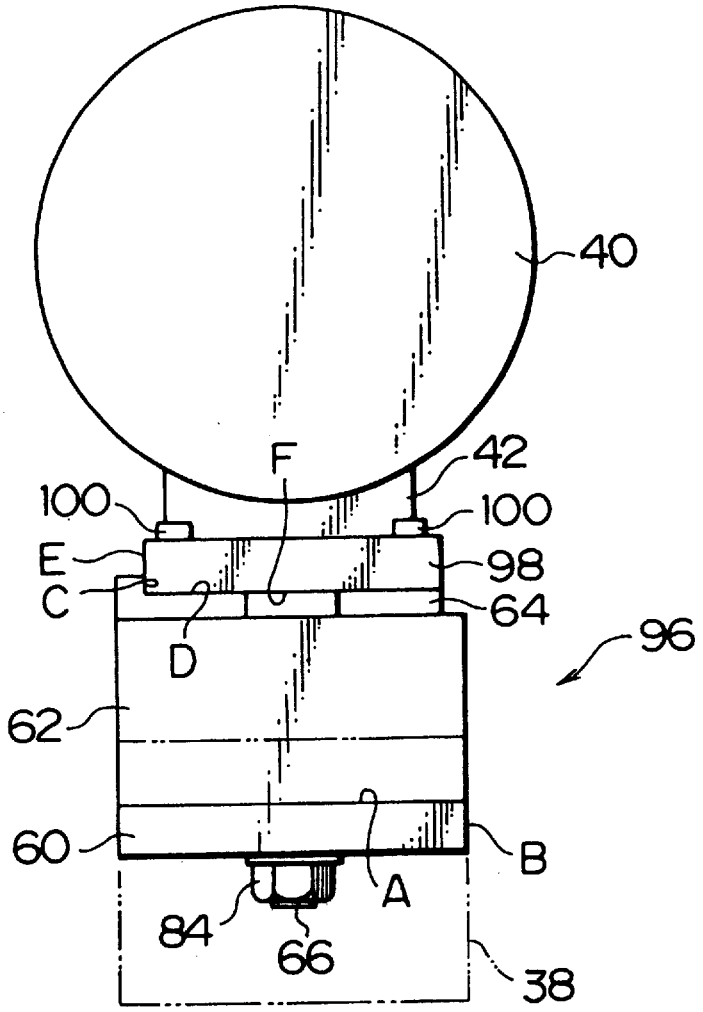
FIG. 8 is a front view illustrating an ingot mounting block in the second embodiment.

Next, the second embodiment will be explained. FIGS. 7 and 8 are a side view and a front view, respectively, of the ingot mounting block in the second embodiment. Incidentally, the same numbers are designated on the same members as those of the ingot mounting block in the first embodiment, so an explanation of them will not be given.

The ingot mounting block 96 in the second embodiment is constructed in such a manner that a work supporting plate 98 is provided at the top of the ingot mounting block 44 of the first embodiment 1. The work supporting plate can be attached and detached freely.

The work supporting plate 98 is fixed to the top of the vertical rocking block 64 via bolts 100 and 100. Therefore, if the bolts 100 and 100 are removed, the work supporting plate 98 can be removed from the vertical rocking block 64.

A horizontal reference plane E is formed at the side of the work supporting plate 98, and a vertical reference plane F is formed at the bottom of the work supporting plate 98. If the work supporting plate 98 is attached to the vertical rocking block 64, the horizontal and vertical reference planes E and F become parallel to the horizontal and vertical reference planes C and D of the vertical rocking block 64.

An explanation will hereunder be given about the operation of the ingot mounting block 96 in the second embodiment, which is constructed in the above-mentioned manner.

First, the semiconductor ingot 40 is attached to the work supporting plate 98 via the slice base mounting beam 42. In this case, the horizontal and vertical references of the semiconductor ingot 40 are parallel to the horizontal and vertical reference planes E and F of the work supporting plate 98.

Next, the work supporting plate 98, to which the semiconductor ingot 40 is attached, is attached to the ingot mounting block 96, of which the crystal orientation has been aligned previously.

As described above, in the second embodiment, the ingot 40 can be attached after the crystal orientation is aligned. As a result, the inclination can be performed easily, and the semiconductor ingot 40 can be replaced and the like more quickly.

Next, the third embodiment will be explained. Incidentally, the same numbers are designated on the same members and apparatus as those in the first and second embodiments, so an explanation of them is omitted here.

Figure 9:
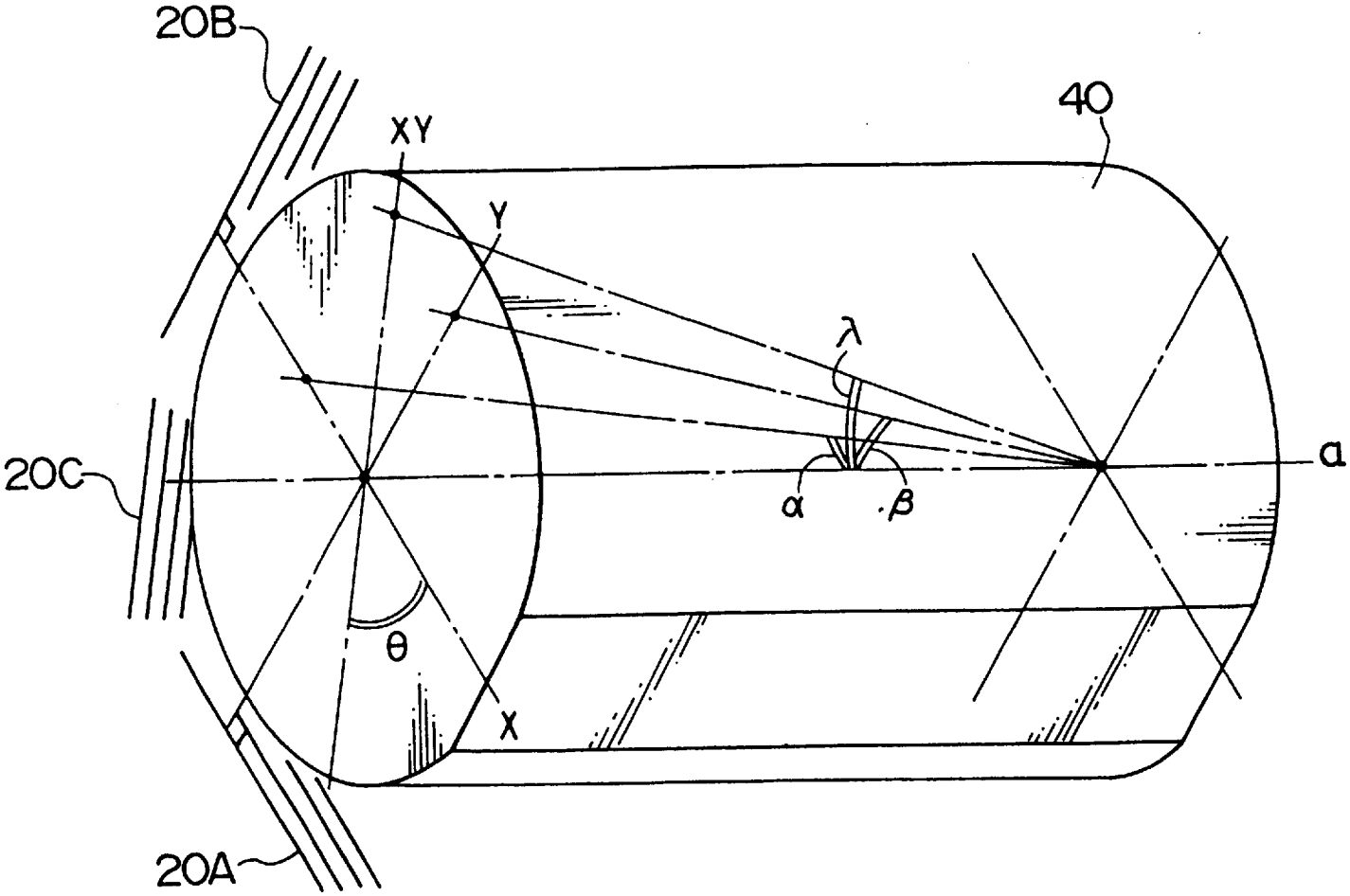
FIG. 9 is a view illustrating a state that a semiconductor ingot inclines with regard to a wire row.

Conventionally, when the crystal orientation of the semiconductor ingot 40 with regard to the wire row 20 is aligned, the semiconductor ingot 40 is first fixed to the work feed table 38 in such a manner to correspond to the vertical and horizontal references of the wire row. Then, the tilting apparatus, which is provided at the work feed table 38, tilts the semiconductor ingot 41 vertically and horizontally by a predetermined angle. In this case, as shown in FIG. 9, the axis X of the semiconductor ingot 40 is at right angles to the wire row 20A, or the axis Y of the semiconductor ingot 40 is at right angles to the wire row 20B.

In the third embodiment, the semiconductor ingot 40 is sliced in such a state that the axes X and Y of the semiconductor ingot 40 are parallel to the wire row 20C. The semiconductor ingot 40 is previously positioned at the ingot mounting block 44 and is fixed there so that the slicing surface of the sliced wafer can be a predetermined crystal surface. The positioned semiconductor ingot 40 is fixed to the work feed table 38 via the ingot mounting block 44.

In this case, the semiconductor ingot 40 is fixed to the ingot mounting block 44 in the following manner.

First, the semiconductor ingot must keep itself in parallel to the wire row 20 in order that the semiconductor ingot 40 is sliced in a state of being parallel to the wire row 20. Moreover, in order that the slicing surface of the sliced wafer is a predetermined crystal surface in this state, the semiconductor ingot 40 is rotated around its axis in the circumferential direction, and the semiconductor ingot 40 is rotated at a predetermined angle in parallel to the wire 20.

Suppose that the vertical and horizontal references of the semiconductor ingot 40 are parallel to the vertical and horizontal references of the wire row 20.

In this case, $\theta$ is an angle by which the semiconductor ingot 40 rotates around its axis in the circumferential direction. $\lambda$ is an angle by which the semiconductor ingot 40 rotates horizontally around its center.

On the other hand, if the vertical and horizontal tilt angles of the semiconductor ingot 40 are $\alpha$ and $\beta$, respectively, in the conventional method of aligning the crystal orientation, there is the following relationship between $\theta$ and $\alpha$ and $\beta$.

$$\theta=\tan^{-1}(\tan\beta/\tan\alpha)$$

Furthermore, there is the following relationship between $\lambda$ and $\alpha$ and $\beta$.

$$\lambda=\tan^{-1}(\tan\alpha/\cos\beta)$$

Therefore, the semiconductor ingot 40 rotates around its axis in the circumferential direction by $\theta$, and rotates horizontally by $\lambda$ to be fixed to the ingot mounting block 44, and the positioned and fixed semiconductor ingot 40 is fixed to the work feed table 38. As a result, the semiconductor ingot can be sliced in parallel to the wire row 20, and the slicing surface of the sliced wafer can be a predetermined crystal surface.

Figure 10A:
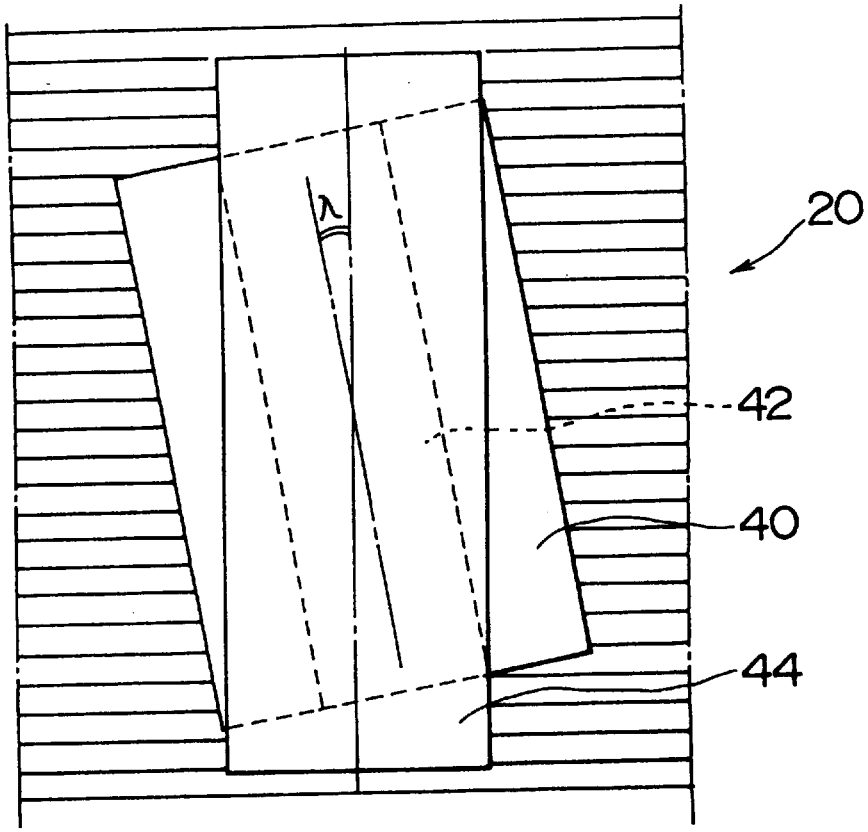
FIGS. 10(*a*) and 10(*b*) are views showing a method of slicing a single crystal material in the third embodiment.
Figure 10B:
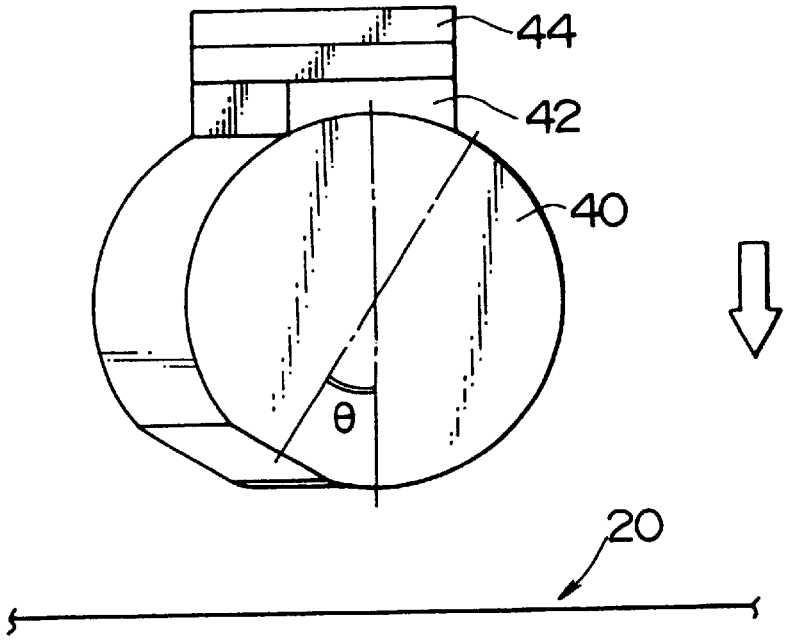

FIGS. 10(*a*) and 10(*b*) show the state that the semiconductor ingot 40, which has rotated around its axis in the circumferential direction by $\theta$ and horizontally by $\lambda$ around its center, is fixed to the ingot mounting block 44 and attached to the work feed table (not shown).

The semiconductor ingot 40 is sliced in this state, so that the semiconductor ingot 40 is sliced in parallel to the wire row 20, and the slicing surface is a predetermined crystal surface. Therefore, the heat is not concentrated on one side of the grooved rollers 18A, 18B and 18C, which form the wire row 20. So, the slicing can be more accurate than the conventional method of inclining the semiconductor ingot 40 in the vertical direction with regard to the wire row 20.

The semiconductor ingot 40 is positioned to be fixed previously, and is fixed to the work feed table 38. Therefore, there is no need for providing the work feed table with the tilting mechanism. As a result, the wire saw 10 can be simplified.

Figure 11A:
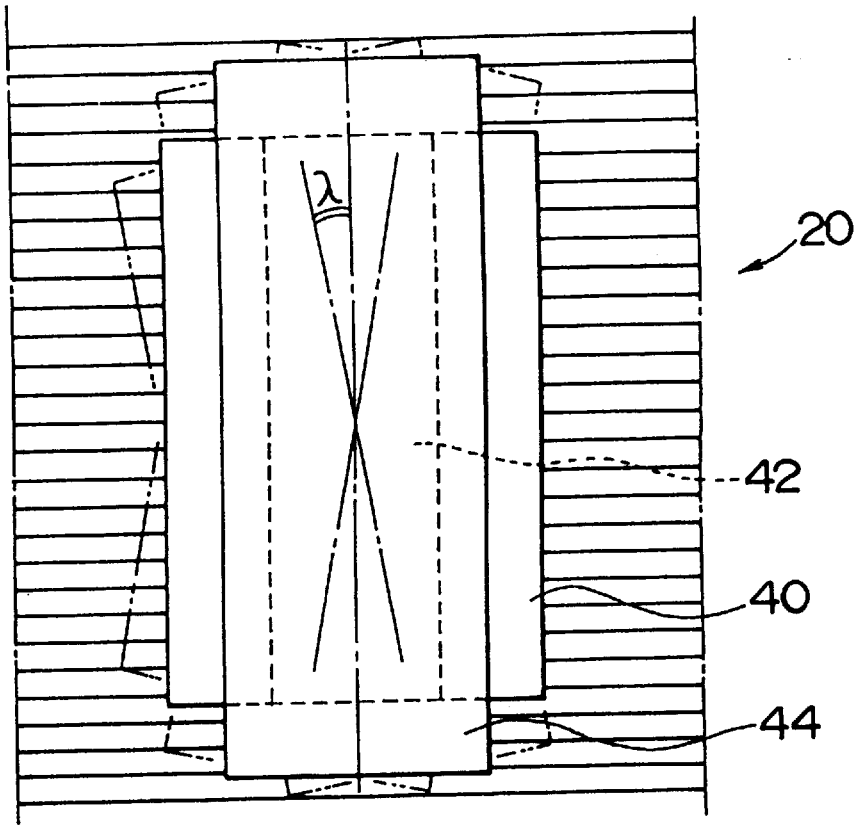
FIGS. 11(*a*) and 11(*b*) are views showing a method of slicing a single crystal material in the third embodiment.
Figure 11B:
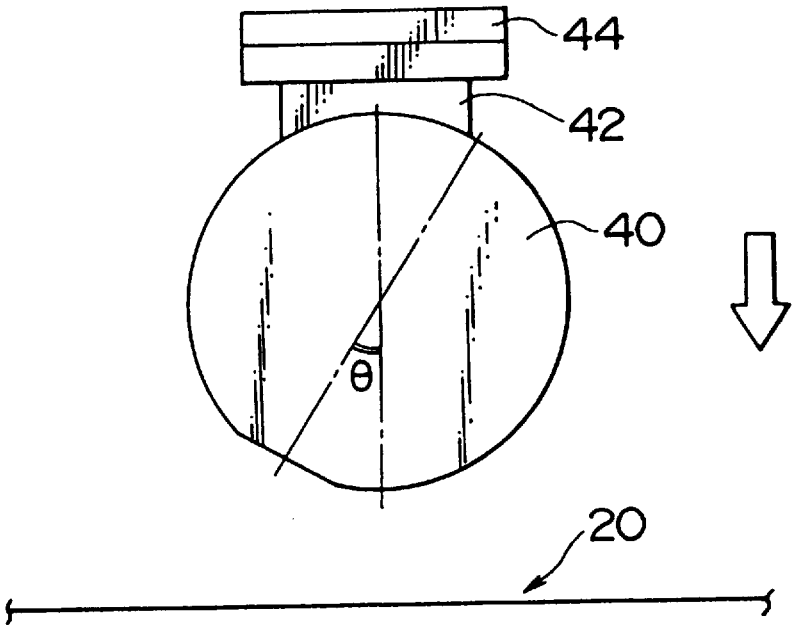

FIG. 11(*a*) and (*b*) show the state the semiconductor ingot 40, which has rotated by $\theta$ around its axis in its circumferential direction, is fixed to the ingot mounting block 4, and is attached to the work feed table (not shown). The semiconductor ingot 40 is rotated $\lambda$ in the horizontal direction by a tilting mechanism, which is provided in the work feed table 38 and rotates in the horizontal direction only.

The semiconductor ingot 40 is sliced in this state so that the semiconductor ingot 40 can be sliced parallel to the wire row 20, and the slicing surface can be a predetermined crystal surface.

Figure 12:
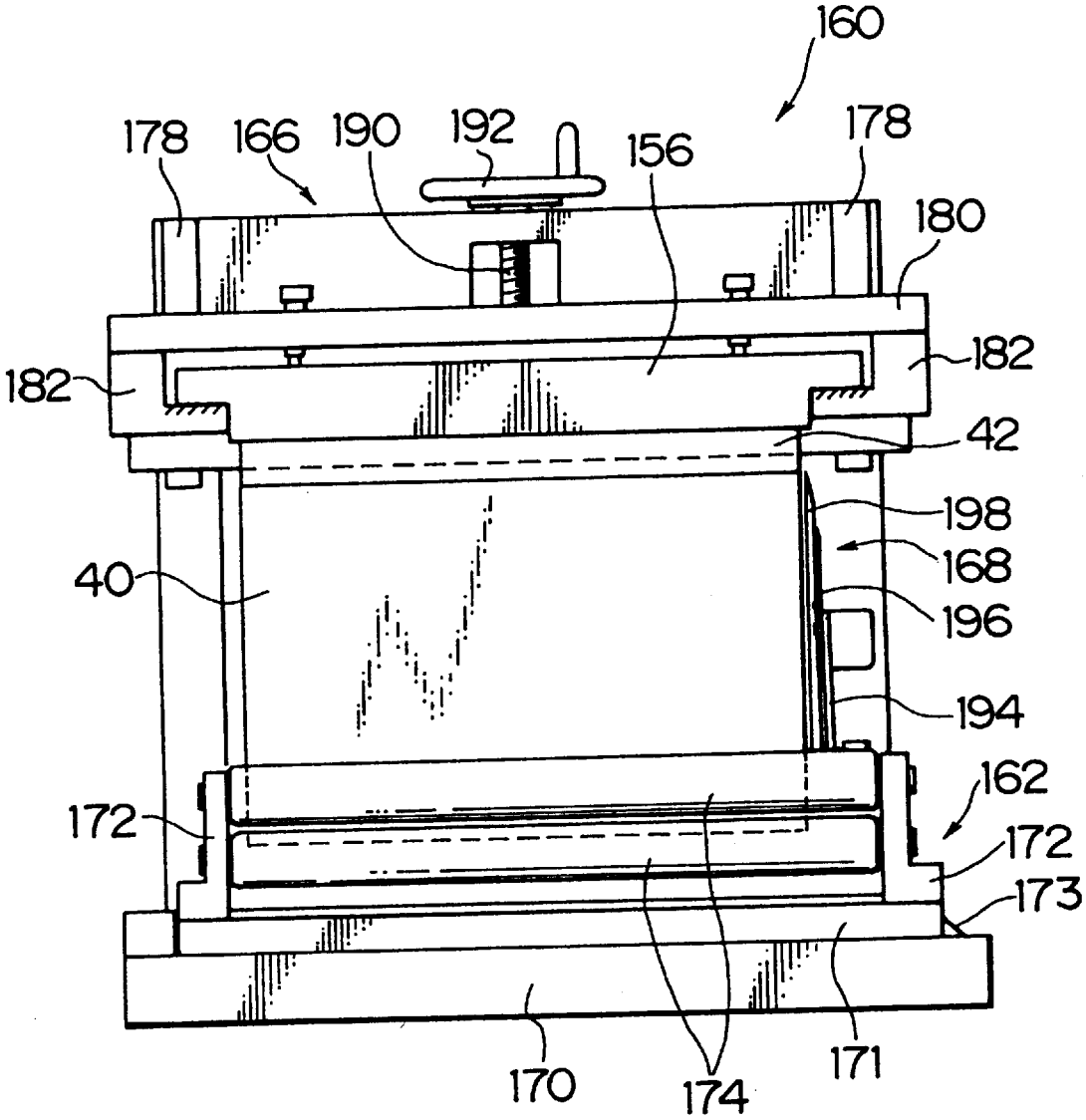
FIG. 12 is a side view of a bonding jig.
Figure 13:
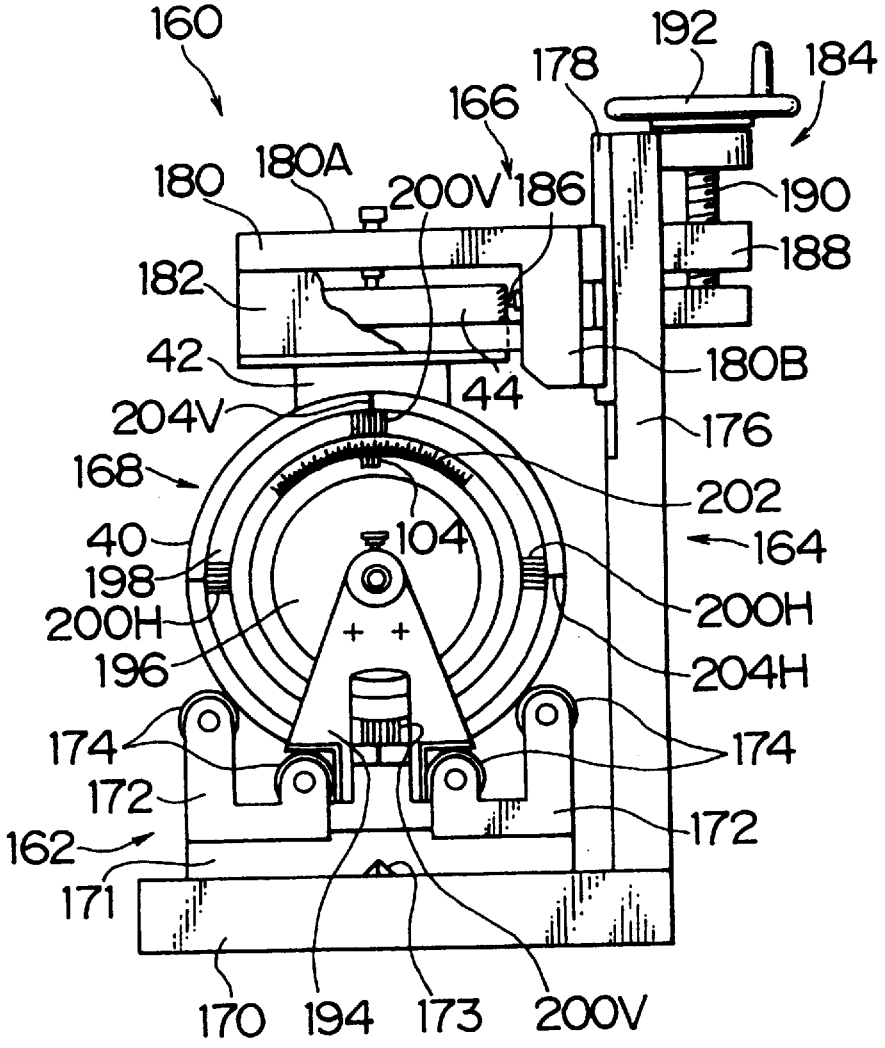
FIG. 13 is a front view of a bonding jig.
Figure 14:
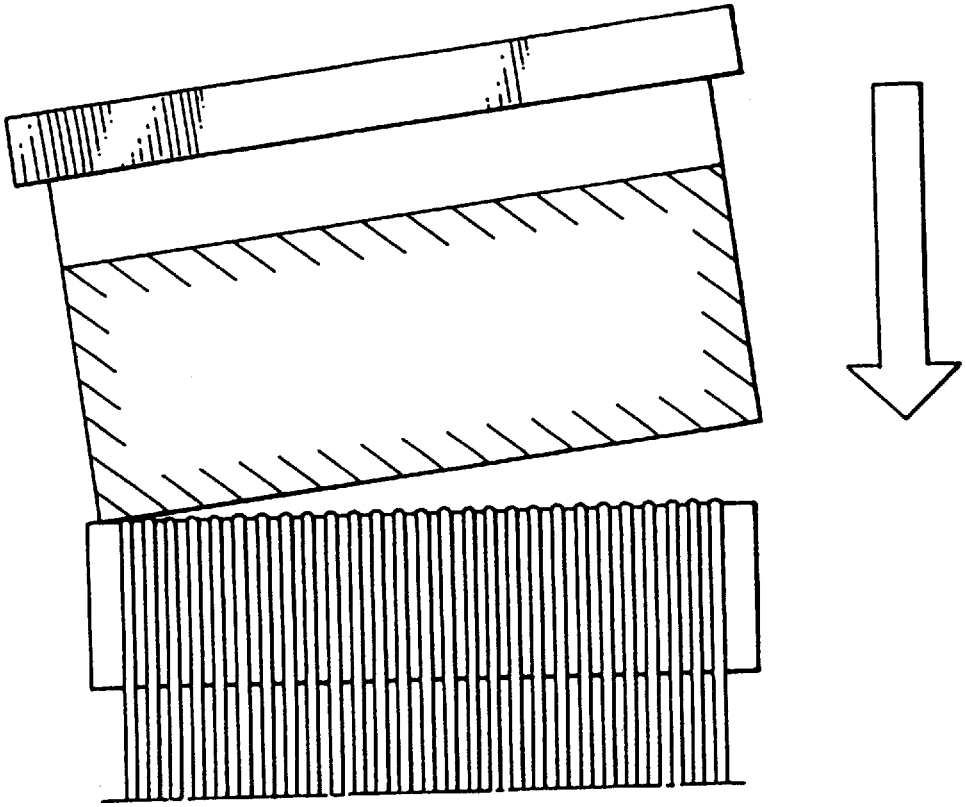
FIG. 14 PRIOR ART
FIG. 14 is a view showing the conventional method of slicing a single crystal material.

FIG. 12 is a side view of a bonding jig for fixing the semiconductor ingot 40 to the ingot mounting block 44, and FIG. 13 is a front view thereof.

As shown in FIGS. 12 and 13, the bonding jig 160 mainly comprises a work receiving part 162, a guide part 164, a lifting part 166, and a positioning part 168.

The work receiving part 162 mainly comprises a base plate 170, a rotary disc 171, work receiving rollers 174, 174, . . .

The rotary disc 171 is rotatively supported on the base plate 170. A rotation graduation (not shown) on the base plate 170 is read by a needle 173, which is provided in the rotational disc 171, so that the rotational angle of the rotary disc 171 can be confirmed.

The work receiving rollers 174, 174, . . . are arranged along the base plate 170, and the both ends of the work receiving roller 174 is rotatably supported by brackets 172 and 172, which are arranged at the rotational disc 171. The semiconductor ingot 40 is placed on the work receiving rollers 174, 174 . . . Incidentally, the semiconductor ingot 40 is placed in a state of being parallel to the base plate 170.

The guide part 164 is composed of a stand supporting plate 176, and guide rails 178 and 178, which are formed at both sides of the supporting plate 176.

The lifting part 166 is composed of a lifting block slicing on the guide rails 178 and 178, and a lifting mechanism 184, which drives the lifting block 180.

The section of the lifting block 180 is L-shaped. Supporting arms 182 and 182 for supporting the ingot mounting block 44 are formed at both sides of the lifting block 180. Each of the lifting block 180 and the supporting arm 182 has a horizontal reference and a vertical reference. The sides of the ingot mounting block 44 are placed on reference pieces 186 and 186, or the bottom thereof is placed on the supporting arm 182, so that the ingot mounting block 44 can be positioned.

A nut part 188 is formed at the back of the lifting block 180. The nut part 188 is engaged with a boll screw 190 arranged along the supporting plate 176. The ball screw 190 rotates if lifting handle 192, which connects the top end of the ball screw 190.

The positioning part 168 is composed of a supporting base 194, a reference disk 196 fixed to the supporting base 194, and a rotation graduation disc 198, which is rotatably supported by the supporting base 194.

The supporting base 194 stands on the rotation disc 171.

The reference disc 196 is a disc-shaped, and a reference graduation 204 is formed at a circumferential edge of the reference disc 196. The reference graduation 204 reads a rotation graduation 202, which is formed at a later-described rotation graduation 198. The reference disc 186 is positioned so that its center can be coaxial with the axis of the semiconductor ingot 40, which is placed on the work receiving rollers 174, 174 . . .

The rotary graduation disc 198 is a disc-shaped, and is rotatably held in a state of being coaxial with the reference disc 196.

The rotation graduation 202, which sets the rotational angle of the semiconductor ingot 40, is formed at the rotary graduation disc 198. The rotary graduation disc 198 is read by a reference graduation 204 formed on the reference disc 196. Angles are graduated on both sides of the central position, which is the reference point of the rotation graduation 202.

Scribing line matching graduations 200V and 200H are formed at regular intervals at the circumferential edge of the rotary graduation disc 198. The scribing line matching graduations 200V and 200H are used for matching the later-described scribing lines (showing the alignment of the crystal orientation of the semiconductor ingot 40) on the cutting face of the semiconductor ingot 40.

Incidentally, the scribing line matching graduation 200V (vertical reference) is an extension of the reference point of the rotation graduation 202. The scribing line matching graduation 200H (horizontal reference) is formed to be perpendicular to the scribing line matching graduation 200V.

As a result, the rotary graduation disc 198 is set so that the reference graduation 204 indicates the reference point of the rotation graduation 202. The scribing line matching graduation 200V (a vertical reference) is vertical to the base plate 170, and the scribing line matching graduation 200H (a horizontal reference) is horizontal to the base plate 170.

In this state, a horizontal scribing line 204H and a vertical scribing line 204V on the cutting face of the semiconductor ingot 40 are matched with the horizontal reference 200 H and the vertical reference 200V of the scribing line matching graduation, respectively. As a result, the horizontal and vertical references of the semiconductor ingot 40 correspond to the horizontal and vertical references of the base plate 170.

Next, an explanation will be given about how to bond the semiconductor ingot 40 by means of the bonding jig 160, which is constructed in the above-mentioned manner.

First, the scribing lines 204H and 204V are lined on one cutting face of the semiconductor ingot 40. They are horizontal and vertical references of the semiconductor ingot 40.

In this case, the scribing line 204V (vertical reference) is a straight line through the center of the orientation flat surface at the semiconductor ingot 40 and the axis of the semiconductor ingot 40. The scribing line 104H (horizontal reference) is a straight line perpendicular to the scribing line 204V.

Then, the supporting arms 182 and 182 of the lifting block 180 support the ingot mounting block 44.

Next, the semiconductor ingot 40 is placed on the work receiving rollers 174, 174, . . . , and the graduation memory 204 is set at a reference position.

Then, the semiconductor ingot 40 is rotated in its circumferential direction. The scribing lines 204H and 204V on the cutting face are matched with the scribing line matching graduations 200H and 200V. As a result, the vertical and horizontal references correspond to the vertical and horizontal references of the base plate 170, respectively. Accordingly, the vertical and horizontal references of the semiconductor ingot 40 correspond to the vertical and horizontal references of the wire row 20.

Next, the rotary graduation disc 198 is rotated by a calculated rotational angle θ around the axis of the semiconductor ingot. As a result, the positions of the scribing line matching graduations 200H and 200V move by the rotational angle θ, so the semiconductor ingot is rotated in its circumferential direction so that the scribing lines 204H and 204V can correspond to the moved scribing line matching graduations 200H and 200V. The semiconductor ingot 40 rotates by θ in its circumferential direction from a position where the vertical reference of the semiconductor ingot 40 corresponds to that of the wire row 20.

Next, a rotary disc 171 is rotated by a calculated rotational angle λ of the semiconductor ingot 40 in the horizontal direction. As a result, the semiconductor ingot 40 is rotated by λ from a position where the horizontal reference of the semiconductor ingot 40 corresponds to that of the wire row 20, and inclines to the wire row 20 horizontally by λ.

The ingot mounting block 44 is lowered in this state, and both sides of the slice base mounting beam, to which the adhesive is applied, is adhered to the semiconductor ingot 40 and the ingot mounting block 44, so that the attachment operation can be completed.

Consequently, the semiconductor ingot 40 is fixed to the ingot mounting block so that the ingot 40 can be parallel to the wire row 20 and its slicing surface can be a predetermined crystal surface.

As explained above, if the bonding jig 60 is used, the semiconductor ingot 40 can be easily attached to the slice base mounting beam 42 and the ingot mounting block 44.

Incidentally, the bonding jig 60 can be employed when the semiconductor ingot 40 is rotated θ around its axis in its circumferential direction and is fixed to the ingot mounting block 44.

As has been described above, according to claim 1 of the present invention, a tilting mechanism in horizontal and vertical directions is provided at the ingot mounting block. Therefore, the work can be inclined previously by a predetermined angle by the ingot mounting block before it is set in the wire saw. As a result, if the ingot mounting block is attached at the wire saw, the work can be replaced quickly.

Moreover, the tilting operation can be performed outside the apparatus main body, so the operation can be safer and easier than the conventional operation at a high place.

Furthermore, there is no need to provide the wire saw's main body with the tilting mechanism for tilting the work, so the wire saw's main body can be simplified.

Furthermore, according to the present invention, the single crystal material is sliced in parallel to the wire row. Therefore, the heat is not clustered on one side of the grooved rollers, and the work can be sliced accurately.

It should be understood, however, that there is no intention to limit the invention to the specific forms disclosed, but on the contrary, the invention is to cover all modifications, alternate constructions and equivalents falling within the spirit and scope of the invention as expressed in the appended claims.

I claim:

1. A method of slicing a single crystal material with a wire saw apparatus in which a running wire is wound around a plurality of grooved rollers to form a wire row, comprising the steps of:

aligning the single crystal material by rotating the single crystal material by a predetermined angle around a central axis in its circumferential direction, said aligning being performed at an aligning location off of the wire saw apparatus;

mounting the aligned single crystal material on an ingot mounting block;

transferring the single crystal material on the ingot mounting block from said alignment location onto a work feed table of the wire saw apparatus without changing the alignment of the single crystal material on the ingot mounting block and attaching the ingot mounting block to the work feed table with the single crystal material parallel to the wire row;

rotating the single crystal material by a predetermined angle around an axis perpendicular to the axis of the single crystal material by a tilting mechanism provided in the work feed table to find a crystal orientation of the single crystal material; and slicing the single crystal material into a number of wafers by moving the work feed table toward the wire row so as to bring the single crystal material into slicing abutment with the wire row.

* * * * *